US009076412B1

(12) United States Patent
Rolling

(10) Patent No.: US 9,076,412 B1
(45) Date of Patent: Jul. 7, 2015

(54) MUSICAL INSTRUMENT STRING BENDER

(71) Applicant: Kenneth J. Rolling, Luverne, MN (US)

(72) Inventor: Kenneth J. Rolling, Luverne, MN (US)

( * ) Notice: Subject to any disclaimer, the term of this patent is extended or adjusted under 35 U.S.C. 154(b) by 162 days.

(21) Appl. No.: 13/732,341

(22) Filed: Dec. 31, 2012

Related U.S. Application Data

(60) Provisional application No. 61/581,818, filed on Dec. 30, 2011.

(51) Int. Cl.

| | |
|---|---|
| ***G10D 3/14*** | (2006.01) |
| ***G10D 3/04*** | (2006.01) |
| ***G10D 1/08*** | (2006.01) |
| ***G10D 3/10*** | (2006.01) |
| ***G10D 3/00*** | (2006.01) |

(52) U.S. Cl.
CPC ..... *G10D 3/146* (2013.01); *G10D 1/08* (2013.01); *G10D 3/04* (2013.01); *G10D 1/085* (2013.01); *G10D 3/14* (2013.01); *G10D 3/143* (2013.01)

(58) Field of Classification Search
CPC ..... G10D 3/143; G10D 3/146; G10D 3/04; G10D 3/14; G10D 1/085
USPC ..... 84/312 R, 267, 312 P, 313, 297 R, 298, 84/299, 307; 984/120, 113, 121; D17/20
See application file for complete search history.

(56) References Cited

U.S. PATENT DOCUMENTS

| | | | | | |
|---|---|---|---|---|---|
| 1,259,062 | A | * | 3/1918 | Wilber | 84/299 |
| 2,073,226 | A | * | 3/1937 | Schrickel | 84/317 |
| 2,741,146 | A | * | 4/1956 | Fender | 84/313 |
| 2,825,256 | A | * | 3/1958 | Smallwood | 84/313 |
| 2,893,282 | A | * | 7/1959 | Searles | 84/313 |
| 3,124,991 | A | * | 3/1964 | Costen | 84/267 |
| 3,174,381 | A | * | 3/1965 | Matthew et al. | 84/313 |
| 3,183,758 | A | * | 5/1965 | Matthew et al. | 84/307 |
| 3,237,502 | A | * | 3/1966 | Moseley | 84/267 |
| 3,479,917 | A | * | 11/1969 | Zitnik, Jr. et al. | 84/312 R |
| 3,512,443 | A | * | 5/1970 | Parson et al. | 84/313 |
| 3,686,993 | A | * | 8/1972 | Fender | 84/312 R |
| 3,721,150 | A | * | 3/1973 | Hoffman et al. | 84/313 |
| 3,854,368 | A | | 12/1974 | Pogan | |
| 4,354,417 | A | * | 10/1982 | Glaser, II | 84/312 R |
| 4,457,201 | A | * | 7/1984 | Storey | 84/313 |
| 4,535,670 | A | * | 8/1985 | Borisoff | 84/312 R |
| 4,549,461 | A | * | 10/1985 | Rose | 84/313 |
| 4,610,190 | A | * | 9/1986 | Maloney | 84/312 R |
| 4,782,732 | A | * | 11/1988 | Kato et al. | 84/313 |
| 4,944,208 | A | * | 7/1990 | Kusek | 84/313 |
| 5,092,214 | A | * | 3/1992 | Flynn | 84/312 P |
| 5,140,884 | A | * | 8/1992 | Bowden | 84/312 R |
| 5,481,954 | A | * | 1/1996 | Parsons | 84/291 |

(Continued)

*Primary Examiner* — David Warren
*Assistant Examiner* — Christina Schreiber
(74) *Attorney, Agent, or Firm* — Albert W. Watkins

(57) ABSTRACT

A guitar string bender bridge mount couples to a guitar bridge through an existing bridge string mount. The bridge mount has a side wall and a slot in and extending to an edge of the side wall. A mounting screw couples into a standard hole on a guitar bridge and is rotatable to adjust the tuning of at least one of the guitar strings. A saddle lever is supported by the bridge mount and is pivotal through a limited arc, limited by low and high stops. The saddle lever is selectively and manually removable from the bridge mount. A string attachment receives and retains a first end of a guitar string. A body wraps about the axis of rotation and is partially wrapped by the guitar string, and the pivoting varies an extent of wrap about the body, to thereby vary a tension upon the guitar string.

16 Claims, 7 Drawing Sheets

(56) References Cited

U.S. PATENT DOCUMENTS

| | | | | | |
|---|---|---|---|---|---|
| 5,537,907 | A * | 7/1996 | Rose | 84/298 |
| 5,567,897 | A * | 10/1996 | McEwen | 84/312 R |
| 5,585,580 | A * | 12/1996 | Higgins | 84/312 R |
| 5,796,020 | A * | 8/1998 | Truitt | 84/266 |
| 5,814,746 | A * | 9/1998 | Stafford | 84/313 |
| 5,986,192 | A * | 11/1999 | Wingfield et al. | 84/313 |
| 6,002,075 | A * | 12/1999 | Carter | 84/312 P |
| 6,201,172 | B1 * | 3/2001 | Denton | 84/313 |
| 6,384,311 | B1 * | 5/2002 | Cota | 84/739 |
| 7,247,779 | B2 * | 7/2007 | Zumsteg | 84/312 P |
| 7,329,808 | B2 * | 2/2008 | Davis | 84/313 |
| 7,696,420 | B2 * | 4/2010 | Thompson | 84/313 |
| 7,759,568 | B2 | 7/2010 | Jackson | |
| 8,163,987 | B1 * | 4/2012 | Dennis | 84/313 |

* cited by examiner

MUSICAL INSTRUMENT STRING BENDER

CROSS REFERENCE TO RELATED APPLICATIONS

The present application claims the benefit under 35 USC 119(e) of U.S. provisional patent application Ser. No. 61/581,818 filed Dec. 30, 2011 and herewith of the same title and inventorship.

BACKGROUND OF THE INVENTION

1. Field of the Invention

This invention pertains generally to the field of stringed musical instruments, and more particularly to a string bender that allows a musician to vary the resonance of a string while playing the instrument.

2. Description of the Related Art

For the purposes of the present disclosure, either the term "bending" or the term "string bending" will be understood to the technique for altering the sound produced by a vibrating string by changing the pitch of the string. Bending can for exemplary purposes be accomplished by pushing or pulling a vibrating string to vary the tension on the string, preferably without dampening the string vibrations. By varying tension, the pitch produced by the vibrating string changes. This is similar to the pitch change during tuning, when the string is tightened or loosened to tune to a proper pitch. However, instead of initial tuning, bending is done during the playing of the instrument, and can be used to create a vibrato sound.

One prior art area where string benders have found great utility is with pedal steel guitars. The pedal steel guitar is a lute-type instrument having a plurality of strings extending generally longitudinally in a horizontal plane. A pedal or lever-actuated pitch changer allows the player to include sounds and musical chords that would not otherwise be available. The pitch changer varies the tension on selected strings or groups of strings. Exemplary pedal steel guitar string benders are illustrated in U.S. Pat. No. 2,893,282 by Searles, entitled "Tone varying attachment for a string musical instrument"; U.S. Pat. No. 5,092,214 by Flynn, entitled "Pitch changing device for a pedal steel guitar"; U.S. Pat. No. 6,002,075 by Carter, entitled "Pitch-changing device for a pedal steel guitar"; U.S. Pat. No. 7,247,779 by Zumsteg, entitled "Pitch changing arrangements for pedal steel guitar"; and U.S. Pat. No. 7,759,568 by Jackson, entitled "Pitch adjustment device for string instruments", the teachings and contents of each which are incorporated herein by reference.

Single string benders are often used by players of the more popular hand-held or strap-supported guitars to simulate the sound of a pedal steel guitar. The most common purpose of a single string bender is to raise the note played on the "B" string by one full note when the lever is fully depressed with the side of the picking hand, though many benders can be used to raise the note by other increments. By depressing the lever before the string is plucked, it can lower the note by the same interval. Although the "B" string is the most common position, a string bender will perform the same function on any of the strings. In addition, there are a number of multiple-string benders that are used to vary the tension on a plurality of strings simultaneously.

A number of patents that illustrate hand-operated string benders, the teachings and contents which are incorporated herein by reference, include U.S. Pat. No. 1,259,062 by Wilber, entitled "Stringed musical instrument"; U.S. Pat. No. 2,073,226 by Schrickel, entitled "Guitar attachment"; U.S. Pat. No. 2,825,256 by Smallwood, entitled "Universal vibrato for musical instruments"; U.S. Pat. No. 3,174,381 by Matthew et al, entitled "Tremolo devices for stringed instruments"; U.S. Pat. No. 3,183,758 by Matthew et al, entitled "Bridges for stringed instruments"; U.S. Pat. No. 3,237,502 by Moseley, entitled "Stringed musical instrument"; U.S. Pat. No. 3,479,917 by Zitnik Jr. et al, entitled "Multiple lever manual tone changer for guitars"; U.S. Pat. No. 4,457,201 by Storey, entitled "Combined bridge and tailpiece assembly for a stringed musical instrument"; U.S. Pat. No. 4,610,190 by Maloney, entitled "Pitch raising system for guitars"; U.S. Pat. No. 5,140,884 by Bowden, entitled "Detachable string bender"; U.S. Pat. No. 6,384,311 by Cota, entitled "Guitar having tremolo device on each string thereof"; U.S. Pat. No. 7,329,808 by Davis, entitled "String bending device for stringed musical instruments"; and U.S. Pat. No. 7,696,420 by Thompson, entitled "String bender for electric guitar". Each of these patents effect tension behind the bridge saddle, meaning that as tension is applied, the string must slide across the saddle. This motion across the saddle is undesirable, since the string sliding accelerates wear and string breakage. Furthermore, the inherent friction can lead to unpredictable variability in pitch both whether or not the bender is activated. Finally, many of these require either custom guitar fabrication or substantial and undesirable alterations.

A patent similar to the hand-operated benders, but which is hip-operated, is U.S. Pat. No. 4,535,670 by Borisoff, entitled "String bender attachment construction", the teachings and contents which are incorporated herein by reference. This patent describes a product known commercially as the Borisoff "Hip-Shot". The "Hip-Shot" suffers from many of the limitations of the aforementioned hand-operated benders, but has nevertheless been widely used among guitar players. A few U.S. patents, the teachings and contents which are incorporated herein by reference, illustrate using the bridge saddle as a pivotal member to induce and vary string tension, including: U.S. Pat. No. 2,741,146 by Fender, entitled "Tremolo device for stringed instruments"; U.S. Pat. No. 3,124,991 by Costen, entitled "Vibrato tuning device for stringed musical instruments"; U.S. Pat. No. 4,354,417 by Glaser II, entitled "Tone changer for stringed instrument"; U.S. Pat. No. 4,782,732 by Kato et al, entitled "Split tremolo device"; and U.S. Pat. No. 4,944,208 by Kusek, entitled "Guitar with adjustable tremolo"; U.S. Pat. No. 5,814,746 by Stafford, entitled "Pitch modifying guitar bridge assembly". While these devices each offer a number of benefits and advantages over much of the prior art, they each also require either substantial material removal and reconstruction of the guitar body or replacement of the entire tail stock, either that therefore necessitates additional drilling or other similar substantial, often irreversible, and very undesirable reworking of the guitar body.

In addition to U.S. Pat. No. 4,354,417 by Glaser II, U.S. Pat. No. 3,512,443 by Parson et al, entitled "Shoulder strap control for string instruments"; U.S. Pat. No. 3,686,993 by Fender, entitled "Shoulder strap-operated pitch-changing means for spanish guitars"; U.S. Pat. No. 5,481,954 by Parsons, entitled "Back plate mounted shoulder strap control for electric type stringed instruments"; and U.S. Pat. No. 5,585,580 by Higgins, entitled "Peg bender" illustrated strap operated benders, the contents and teachings of each which are incorporated herein by reference.

Undesirably, many of these aforementioned benders, including these prior art strap benders and many of the hand-actuated benders, require substantial machining or other permanent alteration or modification of existing guitar structures. This makes installation or removal of the bender far more difficult or impossible, and can adversely impact the value of the guitar. As a result, many players are understandably hesitant to install a bender.

Two additional U.S. patents that describe bridge tuning apparatus without string bending, the teachings and contents which are incorporated herein by reference, include: U.S. Pat. No. 4,549,461 by Rose, entitled "Apparatus for restraining and fine tuning the strings of a musical instrument, particularly guitars"; and U.S. Pat. No. 5,537,907 by Rose, entitled "Tuning systems for stringed instruments".

In addition to the aforementioned patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is, in combination, a guitar having a plurality of guitar strings, a guitar bridge having a plurality of bridge string mounts coupling to ones of said plurality of guitar strings, and at least one string bender coupled with at least one of said guitar strings through an existing coupling to said guitar bridge.

In a second manifestation, the invention is a saddle lever.

In a third manifestation, the invention is combination saddle lever and bridge mount.

OBJECTS OF THE INVENTION

A first object of the invention is to provide a string bender that is a direct replacement for existing and common bridge couplings, without necessitating machining, defacing or other permanent alteration or modification of existing guitar structures. A second object of the invention is to enable string bending while eliminating string sliding and the associated accelerated string wear and breakage. Another object of the present invention is to enable rapid string changes, without the need to tune all strings, and instead only tune the replaced string. A further object of the invention is to return the string to the as-tuned pitch after the string has been bent and then released. Yet another object of the present invention is to affect a pitch change within only one selected string during bending, and not unintentionally alter the pitch of other strings. An additional object is to limit the movement and force required to change string tension, and for the movement to occur silently and without reducing the tonal quality of the instrument. A further object is to set the pitch range of the bender with high and low limits, independently controlled relative to string tuning. Another object is to provide an adaptation that permits the bender to be manually pushed or pulled with a cord or the like. A further object is to provide an optional strap pull that is interior to guitar back.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
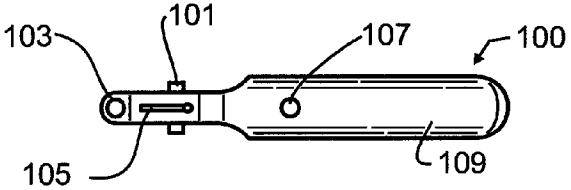
FIG. 1 illustrates a first preferred embodiment string bender saddle lever designed in accord with the teachings of the present invention from a top plan view.
Figure 2:
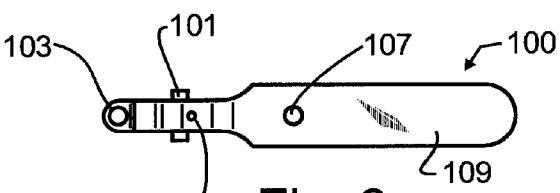
FIG. 2 illustrates the first preferred embodiment string bender saddle lever of FIG. 1 from a bottom plan view.
Figure 3:
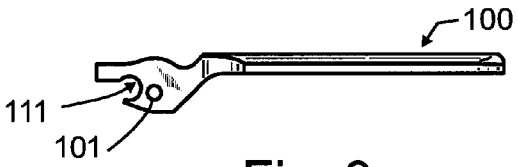
FIG. 3 illustrates the first preferred embodiment string bender saddle lever of FIG. 1 from a side elevational view.
Figure 4:
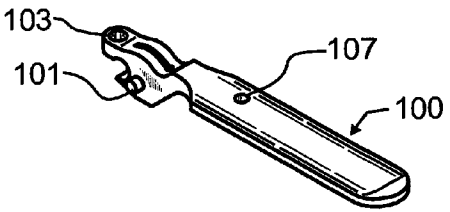
FIG. 4 illustrates the first preferred embodiment string bender saddle lever of FIG. 1 from a projected view.

One type of guitar commonly used by musicians who employ string benders is the Fender Telecaster and derivatives and copies. On these guitars, there are two major categories of bridge designs. One design uses six individual bridge saddles, similar to that illustrated by FIG. 2 of Kato et al in U.S. Pat. No. 4,782,732 incorporated by reference herein above. The other design uses three bridge saddles with two strings per saddle, similar to that illustrated by FIG. 2 of Parson et al in U.S. Pat. No. 3,512,443 incorporated by reference herein above. The preferred embodiment string benders are illustrated with reference to these two major categories, though it will be appreciated from a reading of the present disclosure that the present invention is not solely limited to application to these types of bridge designs, and that the present teachings may also be applied to other bridge designs.

Figure 10:
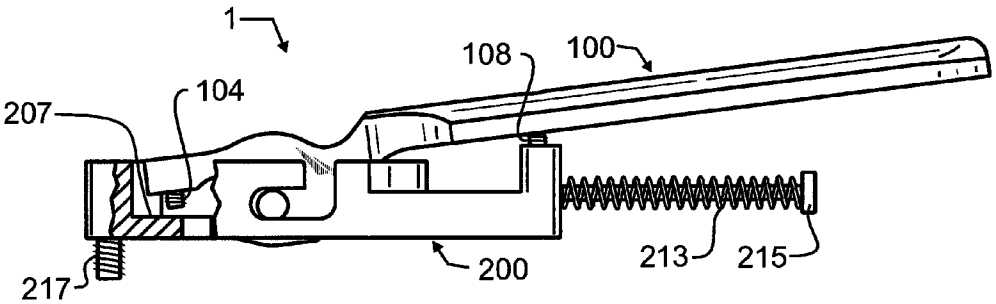
FIG. 10 illustrates a first preferred embodiment string bender designed in accord with the teachings of the present invention and incorporating the string bender bridge mount of FIG. 7 from a side and partial sectional view to reveal both stops of the string bender saddle lever of FIG. 1 within the bridge mount.

In one preferred embodiment of the invention, for exemplary purposes illustrated in FIG. 10, a string bender 1 is comprised of a bridge mount 200 and a saddle lever 100. Saddle lever 100, for exemplary purposes illustrated in FIGS. 1-4, has two pivot pins 101 extending transversely and protruding from the lever. These pivot pins 101 operatively fit into slot 201 in string bender mounting block body 205, and serve as a pivotal axis that allows saddle lever 100 to pivot through a limited arc relative to bridge mount 200.

Bridge mount 200 has a mounting and intonation screw 215 which couples into a standard hole on a guitar bridge, so that bridge mount 200 may be used to replace one or more of the existing string mounts. Mounting and intonation screw 215 is used when a string is in place to adjust the tuning of the string, simply by rotating mounting and intonation screw 215 in either a clockwise or counterclockwise fashion, exactly as prior art mounting and intonation screws function. To facilitate the centering of mounting and intonation screw 215 in head end 203 of string bender mounting block body 205, a small trough, slot or hole 212 may be machined or otherwise formed in string bender mounting block body 205, thereby avoiding undesired interference between mounting and intonation screw 215 and string bender mounting block body 205.

An optional spring 213 may be provided about the threaded shaft of mounting and intonation screw 215. If spring 213 is provided, it will help to hold string bender 1 in place, and thereby prevent undesirable rattling, even when no strings are tensioned.

While other methods of termination are contemplated herein, in the preferred embodiments a guitar string 50 will terminate by wrapping about or otherwise being affixed with a small metal tube or the like as is known in the art, and string loop attachment 111 will receive the string terminating loop and tube therein. String 50 will pass from string loop attachment 111 down and then towards mounting and intonation screw 215, passing below the axis defined by pivot pins 101 before rising up and passing through string tunnel 113. String 50 then passes over string saddle contact point 105, and from there will preferably stay elevated above guitar body 40 until it reaches the distal string terminating anchor point.

As may be apparent from FIG. 10, when saddle lever 100 is pivoted about the axis defined by pivot pins 101, such as by a musician pressing upon the long handle end 109 of saddle lever 100, this will cause saddle lever 100 to rotate about pivot pins 101, and thereby wrap additional string 50 about saddle lever 100. This of course adds tension to the string, and will in turn change pitch. The extent of pitch change is optionally, but preferably, set in a first direction by the extent that low stop adjustment screw 104 passes through hole 103, which sets the lowest pitch available. At some angle of rotation of saddle lever 100 about pivot pins 101, low stop adjustment screw 104 will come to rest against bottom lip 207, preventing further rotation in that direction. When no other forces are applied to saddle lever 100, the tension within string 50 will cause saddle lever 100 to rotate so that low stop adjustment screw 104 will come to rest against bottom lip 207. In this position, string 50 is most relaxed, meaning it will vibrate at the lowest frequency or pitch.

The extent of pitch change is optionally but preferably set in a second direction opposite to the first direction by the extent that high stop adjustment screw 108 passes through hole 107, which sets the highest available pitch. In the preferred embodiment bridge mount 200, high stop adjustment screw 108 will come to rest against the head end 203 of string bender mounting block body 205, though this in not critical, and, alternatively, high stop adjustment screw 108 might for exemplary purposes come to rest against end wall 211 of string bender mounting block body 205.

Prior art string saddles also have string height adjustment screws, and preferred embodiment string bender 1 has one or preferably a pair of these screws 217 passing through holes 209 in bridge mount 200 for the same purpose.

Figure 9:
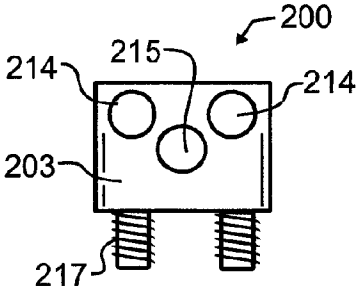
FIG. 9 illustrates the first preferred embodiment string bender bridge mount of FIG. 7 from an end elevational view.
Figure 7:
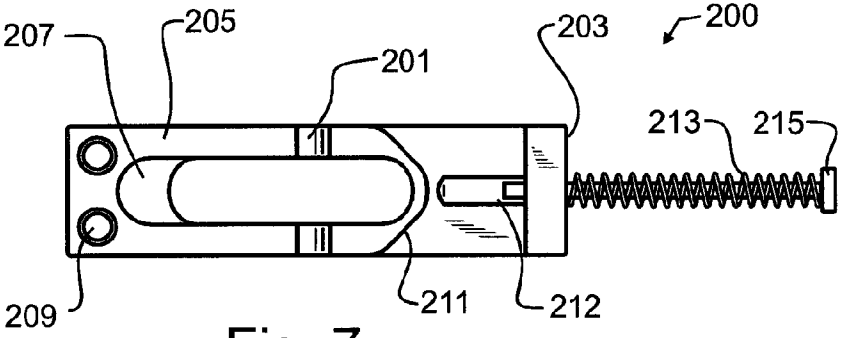
FIG. 7 illustrates a first preferred embodiment string bender bridge mount designed in accord with the teachings of the present invention from a top plan view.
Figure 8:
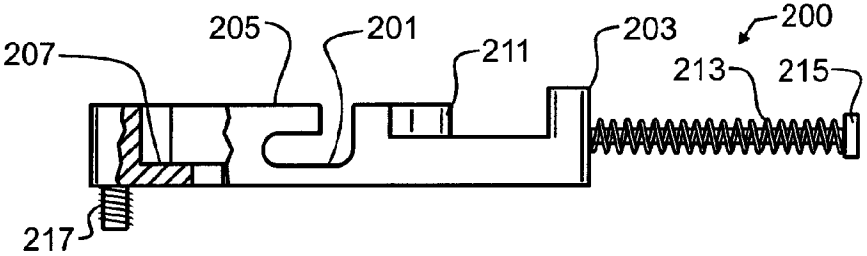
FIG. 8 illustrates the first preferred embodiment string bender bridge mount of FIG. 7 from a side elevational view.

FIGS. 7-9 illustrate the preferred embodiment bridge mount 200 from top, side and end views, respectively. Two additional threaded holes 214 are visible in FIG. 9 that accommodate two set screws. These set screws are operative to bear against the top of the bridge plate after mounting and intonation screw 215 is adjusted for proper intonation. This will keep the front of the assembly from rising up when the lever is depressed.

Figure 5:
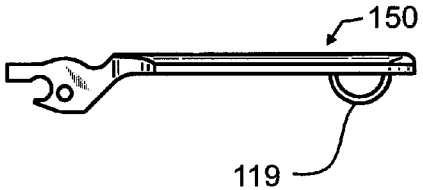
FIG. 5 illustrates a second preferred embodiment string bender saddle lever designed in accord with the teachings of the present invention from a side elevational view.
Figure 6:
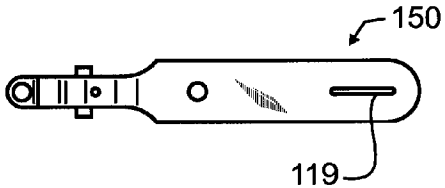
FIG. 6 illustrates the second preferred embodiment string bender saddle lever of FIG. 5 from a bottom plan view.

FIGS. 5 and 6 illustrate a second preferred embodiment saddle lever 150 which is identical to saddle lever 100, but with the addition of a loop 119 that permits a "pull" device, cord, strap, lever or some other device to be used to activate or pull down on saddle lever 150. This could be connected to the player's belt or belt loop by a strap running through a small hole through the guitar, front to back, as for exemplary purposes illustrated in FIG. 14.

While not separately illustrated herein, it will be understood that the preferred embodiments may be adapted for better form, fit or function with a particular brand or style of bridge. For exemplary purposes only, and not solely limiting thereto, projections or wings may be provided that extend from the lower sides of bridge mount 200. These projections on each side would be located immediately under slots 201, and extending transversely from the base and in a plane roughly parallel with the bottom surface of bridge mount 200. These may then slip under a standard string saddle on either side of string bender 1, to further prevent string bender 1 from rising when saddle lever 100 is depressed.

Figure 11:
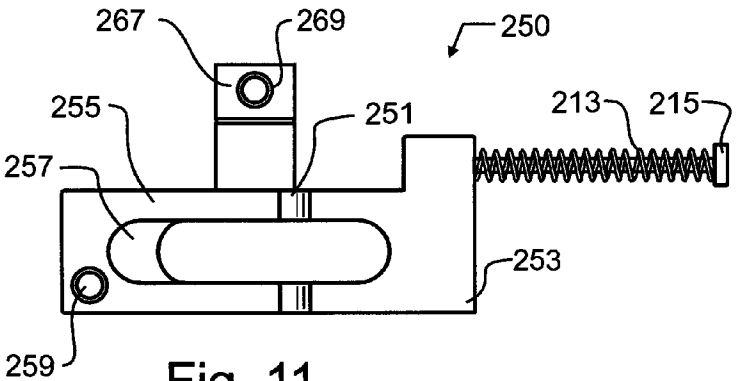
FIG. 11 illustrates a second preferred embodiment string bender bridge mount from a top plan view, designed for incorporation into a three barrel bridge assembly.
Figure 12:
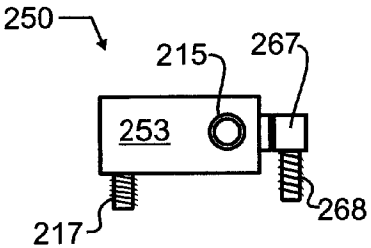
FIG. 12 illustrates the second preferred embodiment string bender bridge mount of FIG. 11 from an end elevational view.

FIGS. 11 and 12 illustrate a second preferred embodiment string bender bridge mount 250 similar to string bender bridge mount 200 of FIGS. 7-9, but redesigned to be operative as illustrated in combination with a three barrel bridge that uses three bridge saddles with two strings per saddle. In this second preferred embodiment, mounting and intonation screw 215 is off-center with respect to the saddle lever slots 251, and a projection 267 is provided off of one side of bridge mount 250. Projection 267 acts as a fixed bridge saddle for the other string in the string pair. Another change in this second preferred embodiment is that rather than a pair of height adjustment screws at the front of the bridge mount, there is one height adjustment screw 268 passing through hole 269 on side projection 267, and one height adjustment screw 217 passing through hole 259 on the string bender mounting block body 255. Head end 253 is functionally equivalent to head end 203, and bottom lip 257 is functionally equivalent to bottom lip 207.

Figure 13:
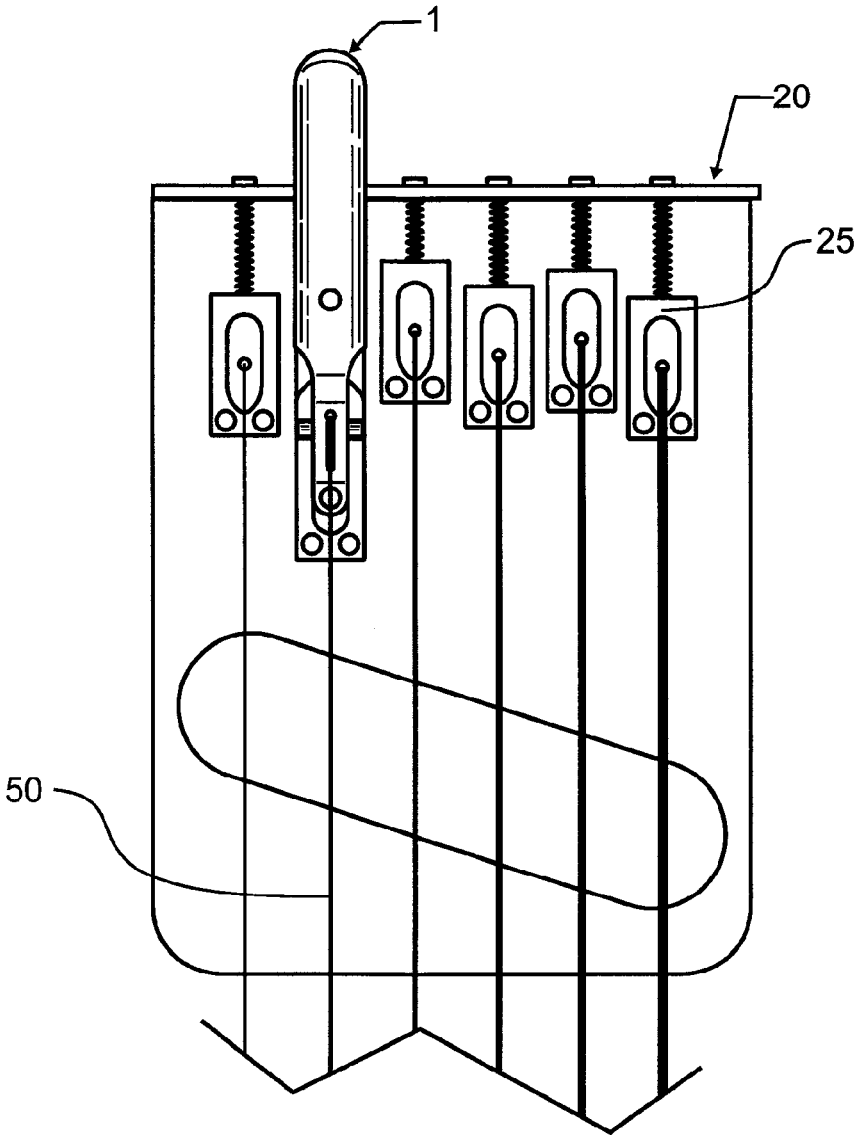
FIG. 13 illustrates a single string bender of identical construction to that illustrated in FIG. 10, placed into a Fender Telecaster bridge assembly having six individual bridge saddles, from a top plan view.

FIG. 13 illustrates a second preferred embodiment string bender 1 of essentially identical construction to that illustrated in FIG. 10, placed into a Fender Telecaster bridge assembly having six individual bridge saddles, using five individual prior art bridge saddles 25 and string bender 1, and further showing the guitar string passing out of string tunnel 113. While only one prior art bridge saddle 25 has been replaced by preferred embodiment string bender 1, any one or more of the six prior art bridge saddles 25 may optionally be replaced. Of particular interest here is that the preferred embodiment string bender 1 may be installed without any machining or retrofitting of the bridge assembly, simply by unscrewing and replacing the mounting and intonation screw 215, while swapping out the prior art bridge saddle with string bender 1.

Figure 14:
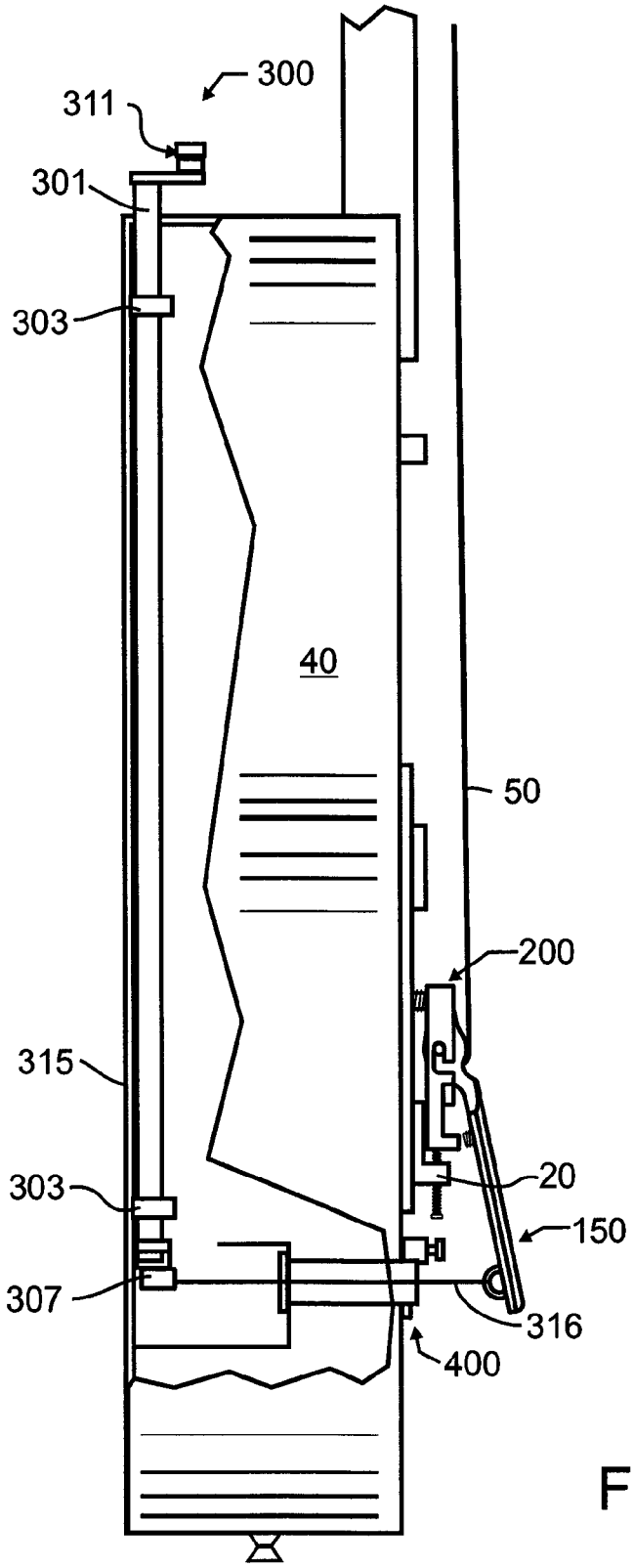
FIG. 14 illustrates the second preferred embodiment string bender saddle lever of FIG. 5 in combination with the first preferred embodiment string bender bridge mount of FIG. 7 and in further combination with a Fender Telecaster bridge assembly having six individual bridge saddles, and further including a preferred embodiment strap actuator and pass-through from a side partially sectional view.
Figure 15:
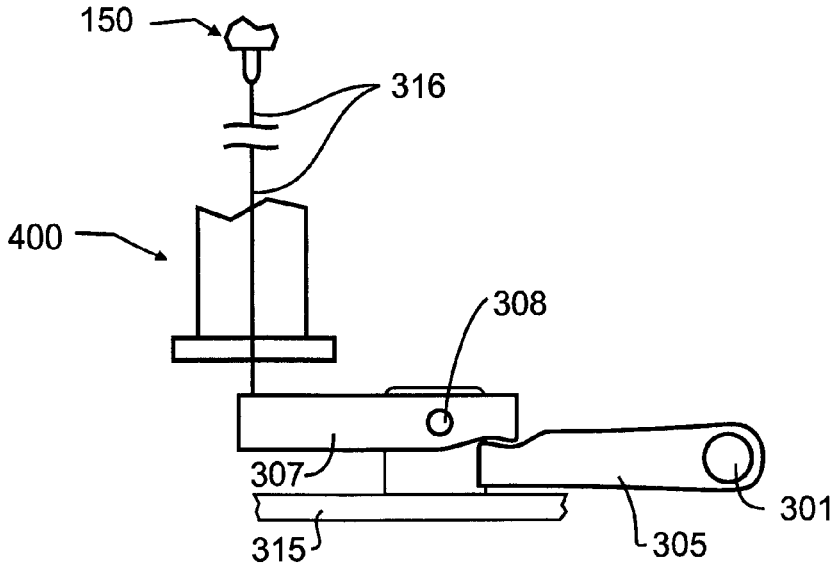
FIG. 15 illustrates the preferred embodiment strap actuator of FIG. 14 schematically, illustrating the operation of the actuating levers.
Figure 17:
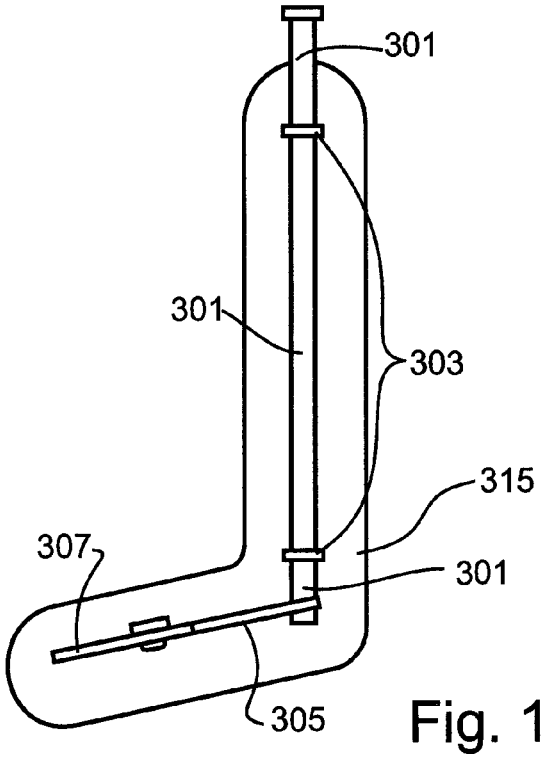
FIG. 17 illustrates the strap actuator of FIG. 14 from an inside view, showing the components and guitar body cover.
Figure 16:
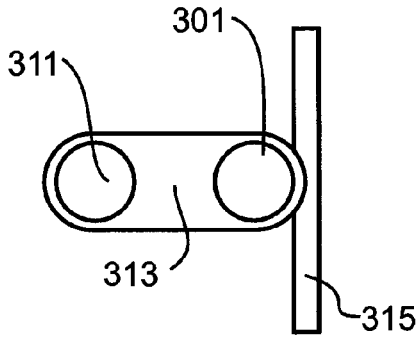
FIG. 16 illustrates the strap actuator of FIG. 14 from an end view.

Besides manual activation of saddle lever 100 by depressing long handle end 109, and pulling on string attachment loop 119 using a simple strap or cord passing though the guitar body, it will be understood that other mechanical linkage may be incorporated to pull the lever down and activate it by some other body movement. FIG. 14 illustrates the second preferred embodiment string bender saddle lever 150 in combination with the first preferred embodiment string bender bridge mount 200 and in further combination with a Fender Telecaster bridge assembly 20, and further including a preferred embodiment strap actuator 300 and pass-through 400. String bender saddle lever 150 includes string attachment loop 119, to which a wire cable 316 or equivalent is attached. Wire cable 316 is preferably tensioned between string attachment loop 119 and puller lever 307, such as is better visible in FIG. 15. Puller lever 307 is pivotally mounted through pintle 308 to back cover plate 315. Engaging with puller lever 307 distally to wire cable 316 and pintle 308 is torsion bar arm 305, which extends from and is rigidly coupled with torsion bar 301. Torsion bar 301 is supported onto cover plate 315 by a pair of mounts 303, which for exemplary purposes comprise bushings or bearings. At the end of torsion bar 301 distal to torsion bar arm 305 is affixed a strap lever 313 which has a strap button 311 affixed thereto and spaced some distance from torsion bar 301. Pulling on strap button 311, which is achieved by extending one's arms and thereby lowering guitar 40, will rotate strap lever 313 in a clockwise direction about torsion bar 301 as viewed from FIG. 16. This rotation of torsion bar 301 will cause a clockwise rotation of torsion bar 305, as viewed from FIG. 15, which will in turn cause puller lever 307 to rotate counterclockwise about pintle 308, and thereby pull on wire cable 316. If the guitarist instead manually depresses saddle lever 150, puller lever 307 will rotate counterclockwise and decouple from torsion bar 305, thereby ensuring independent activation by either manual or strap force.

Figure 18:
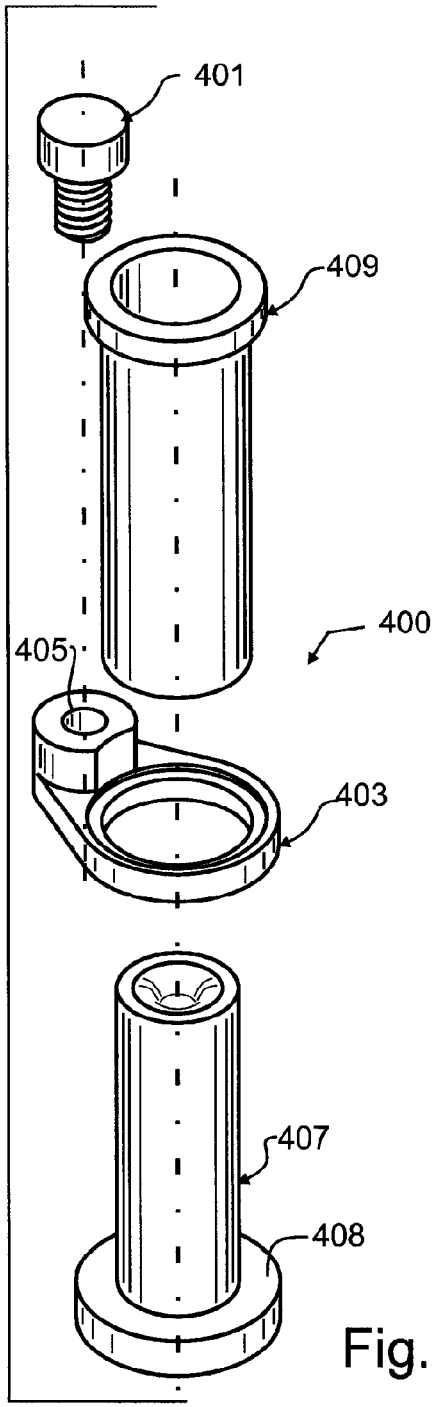
FIG. 18 illustrates the preferred embodiment pass-through of FIG. 14 from an exploded and projected view.
Figure 19:
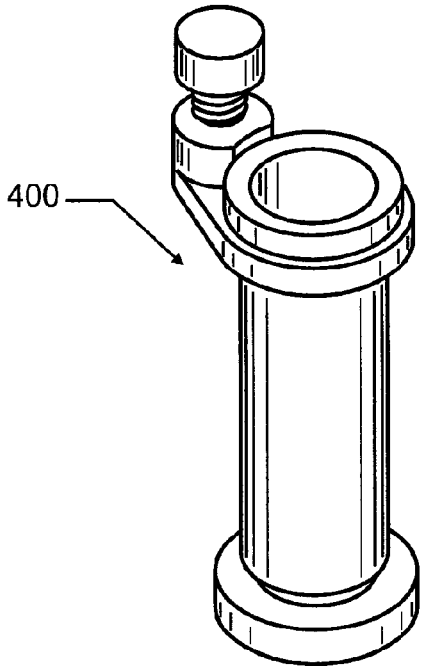
FIG. 19 illustrates the pass-through of FIG. 14 from a projected view.

FIG. 18 illustrates a preferred embodiment pass-through 400 from an exploded and projected view, while FIG. 19 illustrates pass-through 400 from an assembled and projected view. The purpose of pass-through 400 is to provide a durable bearing surface through which wire cable 316 may pass in a relatively friction-free and non-damaging way, to either guitar 40 or wire cable 316, while also relatively isolating the back and front sides of guitar 40 from each other. To accommodate varying thicknesses of wood or other guitar body materials, front ferrule 407 slips into back ferrule 409 in a telescopic manner. Front ferrule 407 has an enlarged base 408 that will engage with one side of an opening drilled through the body of guitar 40. On the top or string surface of guitar 40 stop plate 403 engages with back ferrule 409, and a threaded hole 405 in stop plate 403 receives a set screw 401, which can be used to set the height of back ferrule 409 relative to the top or string surface of the body of guitar 40. In this manner, a large variety of hole sizes and depths and also a variety of saddle lever heights can be accommodated.

As may be understood from these Figures, if properly set up a string bender bridge designed in accord with the teachings of the present invention still allows full function of standard Fender Stratocaster style tremolo systems. The present invention has several advantages over the prior art. The present invention is device is a "drop-in-replacement" for the standard bridge piece on the style of guitar most commonly used and requires no permanent modification of the instrument. The present invention can be used while the performer is sitting or standing and does not require manipulation of the instrument to pull or push any levers either through direct contact with the player or through the use of straps or levers. The present invention could be used in conjunction with other string benders to provide the player with the ability to bend multiple strings in any combination. Unlike other prior art string benders which are operated by the performer's picking hand, this device does not hang over the vibrating portion of the strings and allows the performer to employ the technique of "string muting" which is not practical with the other benders. Additionally, in the present invention, other saddle levers may be provided that are bent to either side, so that multiple benders can be accommodated on the same instrument.

Either at the time of initial installation, or subsequent to a string break, saddle lever 100, 150 may be removed from string bender bridge mount 200, 250 by simply sliding pivot pins 101 through slots 201, 251 and lifting saddle lever 100, 150 from string bender bridge mount 200, 250. A string is then installed using a tube or loop, and is passed through string tunnel 113 and eventually to the opposed end of guitar 40 for anchoring. Then pivot pins 101 are again inserted into slots 201, 251. Mounting and intonation screw 215 is turned, causing string 50 to tension. This string tension drives pivot pins 101 to the bottom or end of slots 201, 251, securing saddle lever 100, 150 into string bender bridge mount 200, 250. This string tension also causes saddle lever 100, 150 to rotate, in a direction counterclockwise as illustrated in FIG. 10, until either low stop adjustment screw 104 contacts bottom lip 207, if low stop adjustment screw 104 is provided, or until saddle lever 100, 150 contacts bottom lip 207. The guitarist will set the rotation of mounting and intonation screw 215 to properly tune string 50. Then the guitarist can next press on long handle end 109, and adjust high stop adjustment screw 108 to set the highest pitch attainable by string bender 1. Since the tension in string 150 creates a strong force rotating saddle lever 100 about pivot pins 101, the low stop will consistently be achieved upon release of any string bender actuation forces, whether applied to long handle end 109 or to strap button 311. Since the string bender provides a rolling string saddle contact point 105, there is minimal string wear since there is no sliding contact. Further, there is no damping of string vibration, only tension change. This means there is only pitch change, without adverse impact to amplitude or volume upon bending.

A string bender designed in accord with the teachings of the present invention may be manufactured from a variety of materials, including metals, resins and plastics, ceramics or cementitious materials, or even combinations, composites or laminates of the above. The specific material used may vary for different applications or needs.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. In combination, a guitar having a plurality of guitar strings, a guitar bridge supporting a plurality of bridge string mounts coupling to ones of said plurality of guitar strings, and supporting at least one string bender coupled with at least one of said guitar strings through an existing bridge string mount coupling to said guitar bridge, said string bender comprising:

a string bender bridge mount coupling to said guitar bridge through said existing bridge string mount, said string bender bridge mount having a side wall and a slot in and extending to an edge of said side wall and also having a mounting and intonation screw which couples into a standard hole on a guitar bridge, said mounting and intonation screw rotatable to adjust the tuning of said at least one of said guitar strings;

a saddle lever selectively supported by said string bender bridge mount and pivotal about an axis of rotation through a limited arc relative to said string bender bridge mount limited in a first direction by a first low stop and limited in a second direction opposed to said first direction by a second high stop, and selectively removable from said bridge mount, said saddle lever having a string attachment operative to receive and retain a first end of said at least one of said guitar strings, a body about said axis of rotation operatively partially wrapped by said at least one of said guitar strings, said pivoting through said limited arc varying an extent of said partial wrap about said body and thereby varying a tension upon said at least one of said guitar strings;

at least one pivot pin coupled with and extending from said saddle lever and passing into said string bender bridge mount side wall and thereby defining said axis of rotation, said saddle lever and said at least one pivot pin selectively removable from said string bender bridge mount by sliding said pivot pin in said slot past said edge of said side wall and then from said slot.

2. The combination guitar, guitar bridge and string bender of claim 1, wherein said string bender bridge mount further comprises two side walls separated by a gap therebetween, each of said two side walls having a "J" shaped channel therein extending from a top edge of said respective side wall, and said at least one pivot pin further comprises two pins protruding transversely from said saddle lever.

3. The combination guitar, guitar bridge and string bender of claim 1, wherein said at least one of said guitar strings further passes from said saddle lever string attachment below said axis of rotation and then rises up and passes through a string tunnel in said saddle lever and over a string saddle contact point, and above a body of said guitar.

4. The combination guitar, guitar bridge and string bender of claim 1, wherein said string bender bridge mount is operative in combination with a three barrel bridge that uses three bridge saddles with two strings per saddle, having a projection extending transversely from one side of said string bender bridge mount and operative to support a second guitar string separate from said at least one of said guitar strings, while permitting said saddle lever to independently bend said at least one of said guitar strings.

5. The combination guitar, guitar bridge and string bender of claim 1, wherein said low stop protrudes on a first side of said axis of rotation; and said high stop protrudes on a second side of said axis of rotation distal to said first side.

6. The combination guitar, guitar bridge and string bender of claim 5, wherein said high stop further comprises a set screw adjustably protruding from a saddle lever manual actuation handle.

7. The combination guitar, guitar bridge and string bender of claim 1, wherein said saddle lever further comprises a manual activation handle extending from said axis of rotation and manually accessible above said string bender bridge mount.

8. The combination guitar, guitar bridge and string bender of claim 7, wherein said saddle lever further comprises a cord activation loop extending from said manual activation handle.

9. In combination, a guitar string saddle lever and bridge mount, comprising:

a string bender bridge mount operatively coupling to a guitar bridge and having a side wall and a slot in and extending to an edge of said side wall;

a saddle lever selectively supported by said string bender bridge mount and pivotal about an axis of rotation through a limited arc relative to said string bender bridge mount limited in a first direction by a first low stop and limited in a second direction opposed to said first direction by a second high stop, and selectively removable from said bridge mount, said saddle lever having a string attachment operative to receive and retain a first end of at least one guitar string, a body about said axis of rotation operatively partially wrapped by said at least one guitar string, said pivoting through said limited arc varying an extent of said partial wrap about said body and thereby varying a tension upon said at least one guitar string;

at least one pivot pin coupled with and extending from said saddle lever and passing into said string bender bridge mount side wall and thereby defining said axis of rotation, said saddle lever and said at least one pivot pin selectively removable from said string bender bridge mount by sliding said pivot pin in said slot past said edge of said side wall and then from said slot.

10. The combination saddle lever and bridge mount of claim 9, wherein said string bender bridge mount further comprises two side walls separated by a gap therebetween, each of said two side walls having a "J" shaped channel therein extending from a top edge of said respective side wall, and said at least one pivot pin further comprises two pins protruding transversely from said saddle lever.

11. The combination saddle lever and bridge mount of claim 9, wherein said at least one guitar string further passes from said saddle lever string attachment below said axis of rotation and then rises up and passes through a string tunnel in said saddle lever and over a string saddle contact point.

12. The combination saddle lever and bridge mount of claim 9, wherein said saddle lever further comprises:

an elongate body defining a longitudinal axis;

said at least one pivot pin protruding in a horizontal plane transversely from opposed sides of said elongate body and located intermediate to said elongate body longitudinal axis and defining said axis of rotation;

said string attachment located between said at least one pivot pin and a first end of said elongate body longitudinal axis;

a manual activation handle extending between said at least one pivot pin and a second end of said elongate body longitudinal axis;

a string tunnel passing transversely through said manual activation handle in a generally vertical plane; and a string path wrapping about said axis of rotation from said string attachment through said string tunnel and to a string saddle contact point.

13. The combination saddle lever and bridge mount of claim 9, wherein said low stop protrudes on a first side of said axis of rotation; and said high stop protrudes on a second side of said axis of rotation distal to said first side.

14. The combination saddle lever and bridge mount of claim 13, wherein said high stop further comprises a set screw adjustably protruding from a saddle lever manual actuation handle.

15. The combination saddle lever and bridge mount of claim 9, wherein said saddle lever further comprises a manual activation handle extending from said axis of rotation and manually accessible above said string bender bridge mount.

16. The combination saddle lever and bridge mount of claim 15, wherein said saddle lever further comprises a cord activation loop extending from said manual activation handle.

* * * * *